United States Patent [19]

Nat

[11] 4,440,994

[45] Apr. 3, 1984

[54] PIVOTED ACTUATOR OFF LOCK SWITCH WITH OPERATOR KEY NONREMOVABLE IN ON POSITION

[75] Inventor: Gursharan P. S. Nat, Smithfield, N.C.

[73] Assignee: Eaton Corporation, Cleveland, Ohio

[21] Appl. No.: 410,103

[22] Filed: Aug. 20, 1982

[51] Int. Cl.[3] ..... H01H 27/00

[52] U.S. Cl. ..... 200/42 T; 200/339; 200/323

[58] Field of Search ..... 200/42 T, 42 R, 315, 200/318, 322, 323, 324, 327, 339, 321

[56] References Cited

U.S. PATENT DOCUMENTS

| | | | |
|---|---|---|---|
| 3,678,229 | 7/1972 | Osika | 200/42 T |
| 3,761,664 | 9/1973 | Kodaira | 200/339 |
| 3,906,176 | 9/1975 | Carlson | 200/42 T |
| 4,013,858 | 3/1977 | Grebner et al. | 200/321 |
| 4,168,416 | 9/1979 | Josemans | 200/323 |
| 4,174,472 | 11/1979 | Josemans | 200/68 |
| 4,230,917 | 10/1980 | Osika | 200/42 T |
| 4,291,207 | 9/1981 | Reinke et al. | 200/42 R |
| 4,345,121 | 8/1982 | Tenner | 200/42 R |

*Primary Examiner*—Stephen Marcus
*Assistant Examiner*—Ernest G. Cusick
*Attorney, Agent, or Firm*—C. H. Grace; L. G. Vande Zande

[57] ABSTRACT

An operator (10) having a lock releasing key (10*a*) formed thereon is removably coupled to a pivoted actuator (6) by resilient tabs (10*d*) depending from the operator which are cammed outwardly over the actuator during coupling operation and which engage with undercut surfaces (6*e*) in the actuator when the operator is fully seated upon the actuator. The tabs (10*d*) seated at one end of the actuator align with formations (4*e*) in the housing (2, 4) in the ON position of the actuator to prevent outward camming movement of the respective tabs, thereby preventing removal of the operator in the ON position.

5 Claims, 6 Drawing Figures

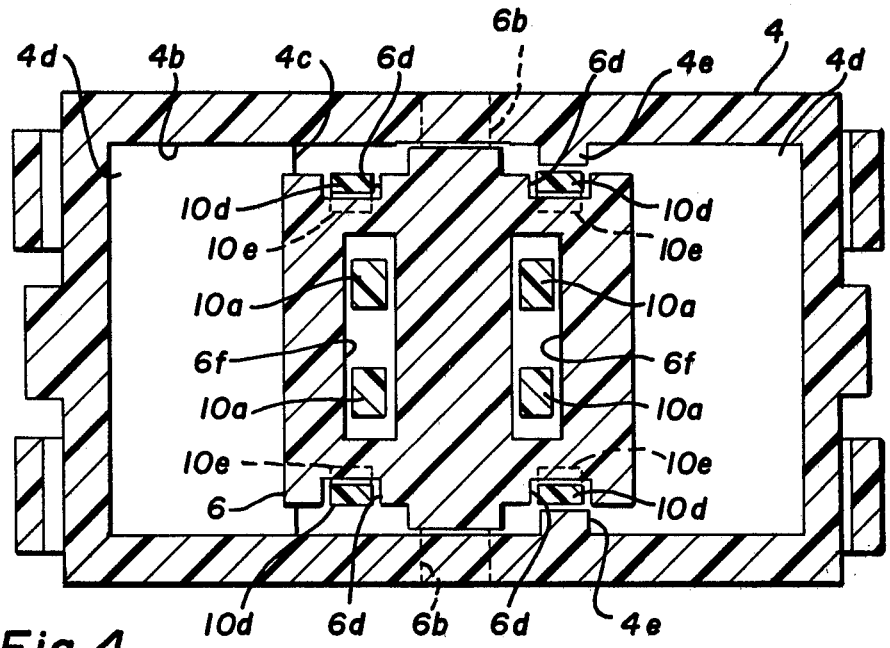
Fig. 4
Fig. 5
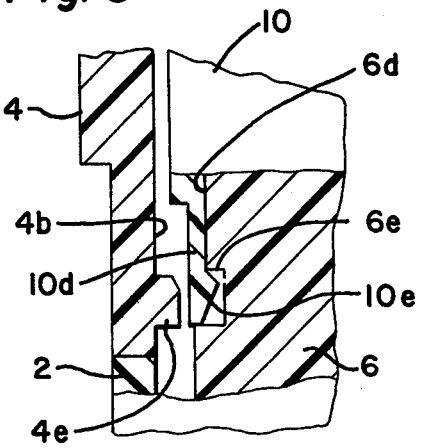
Fig. 6
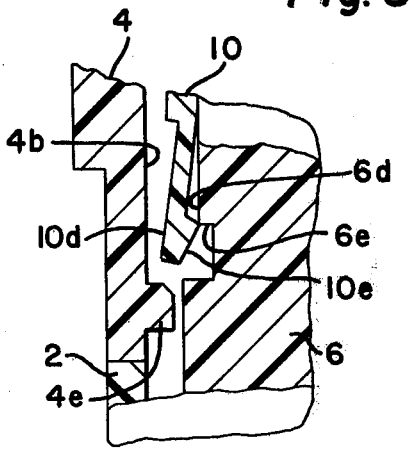

PIVOTED ACTUATOR OFF LOCK SWITCH WITH OPERATOR KEY NONREMOVABLE IN ON POSITION

BACKGROUND OF THE INVENTION

This invention relates to pivoted actuator switches such as rocker switches or toggle lever switches. More specifically the invention relates to switches of the aforementioned type wherein the actuator contains an integral locking member operable to lock the switch in an OFF position when a separable operator member or key is removed therefrom.

Switches of the aforementioned type have been known heretofore. One such switch is disclosed and claimed in Grebner et al U.S. Pat. No. 4,013,858, which is assigned by mesne assignments to the assignee of this invention. The disclosure of the above identified patent is incorporated herein by reference. In the above identified patent, the operator member or key may be removed from the switch in either position, and if so removed when the switch is in the ON position the actuator, which remains pivotly supported to the switch, may be operated manually to the OFF position wherein an integral lock functions to lock the switch in the OFF position until such time as the operator member is reassembled to the switch.

It is desirable in some applications of these switches to prevent removal of the operator when the switch is in the ON position. U.S. Pat. No. 4,168,416, issued Sept. 18, 1979, to L. J. Josemans and assigned by mesne assignments to the assignee of this invention, discloses a switch of the aforementioned type wherein laterally extending bosses are provided on the operator member to fit within arcuate slots formed in upstanding guards on the housing when the switch is in the ON position to permit removal of the operator member only when the switch is in the OFF position. While this switch functions well for its intended purpose, the interrelated structural components of the operator and housing to achieve this purpose render the molding process for these parts more complex and accordingly increases the manufacturing costs of this switch.

SUMMARY OF THE INVENTION

This invention provides a pivoted actuator switch having a lock operable to lock the switch in the OFF position and a removable operator member assembled to the actuator to release the lock and means economically formed on the switch housing for preventing removal of the operator when the switch is in the ON position.

This invention provides a switch having an actuator pivotly supported within an insulating housing and movable between ON and OFF positions for actuating switch contacts within the housing, a locking means carried by the actuator for locking the actuator in the OFF position, an operator removably coupled to the actuator for releasing the locking means, coupling means on the operator which are cammed outwardly upon coupling movement of the operator to the actuator and which subsequently move inwardly to engage cooperating formations on the actuator to releasably retain the operator coupled to the actuator, and means on the housing aligned with the coupling means when the actuator is moved to the ON position for preventing outward movement of the coupling means.

The invention and its advantages will be more fully understood when reading the following description in conjunction with the accompanying drawings.

BRIEF DESCRIPTION OF THE DRAWINGS

FIG. 4 is a cross-sectional view drawn to an enlarged scale taken along the line 4—4 in FIG. 3;

FIG. 5 is an enlarged fragmentary sectional view of a detail shown in FIG. 3; and FIG. 6 is an enlarged fragmentary sectional view similar to FIG. 5, but showing the switch actuator and operator elements moved to displaced positions.

DESCRIPTION OF THE PREFERRED EMBODIMENTS

Figure 1:
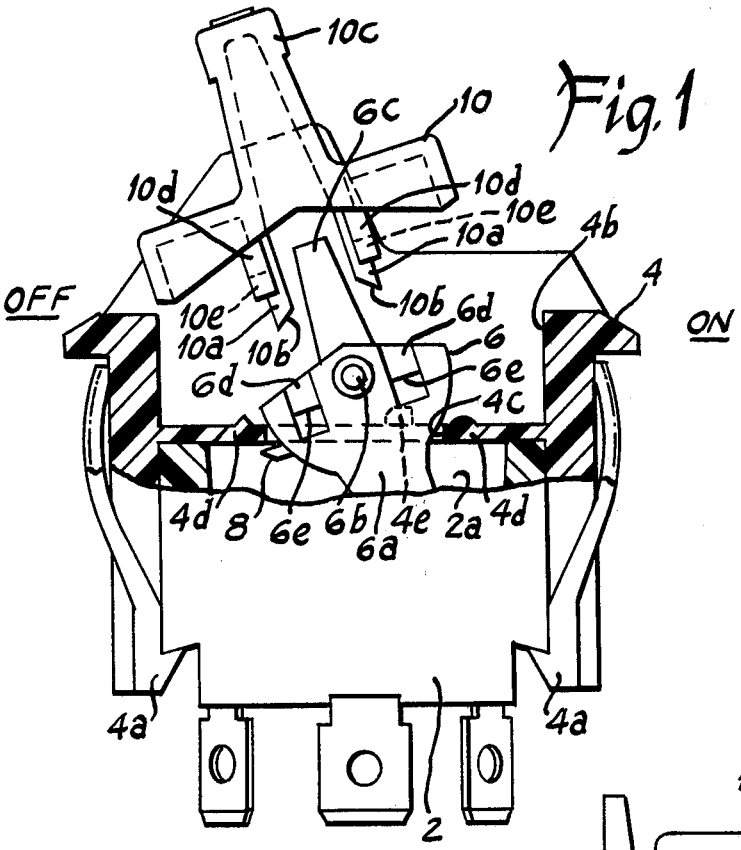
FIG. 1 is an enlarged side view, partially in section, of the pivoted actuator off locking switch of this invention showing the switch in the OFF position and the operator member removed from its coupled position with the actuator.

Referring to FIG. 1, there is shown a pivoted actuator off locking switch provided with a molded insulating housing comprising a base 2 secured to a molded frame 4 by hooks 4*a* integrally molded with the frame. Frame 4 has an opening 4*b* communicating with its upper surface and with a cavity 2*a* of base 2 through a smaller opening 4*c* formed in a horizontal wall 4*d* of the frame. An actuator assembly 6 is pivotally supported in the frame 4 within the opening 4*b* and has a lower stem 6*a* projecting downwardly into the cavity 2*a* through the opening 4*c*. The pivotal support for actuator assembly 6 may be provided by a pin which extends through the actuator assembly 6 and through the opposite sidewalls of the frame 4, or may preferably be provided by trunnions 6*b* molded integrally with the actuator and extending laterally into holes (not shown) in the side walls of frame 4. While not shown herein, stem 6*a* includes a contact actuating mechanism which has connection with switch contacts mounted in the cavity 2*a* of base 2 in a manner disclosed in the above reference patents. The actuator assembly 6 also has a wedge-shaped guide 6*c* molded integrally therewith and projecting upwardly from its upper surface.

Figure 2:
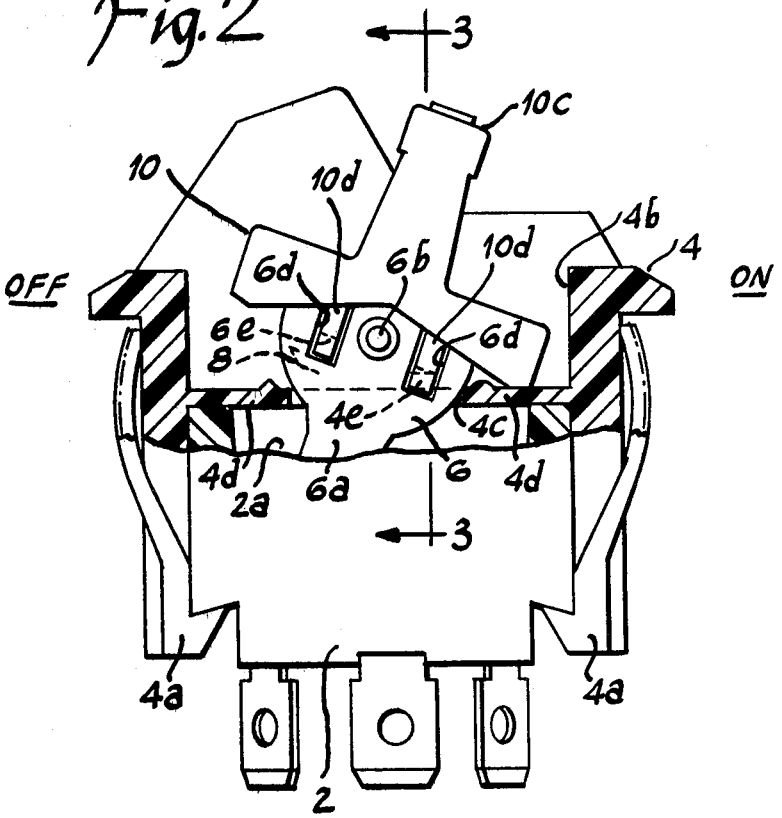
FIG. 2 is a view similar to FIG. 1 but showing the operator coupled to the actuator and the switch in the ON position.

A locking pin 8 is slidably carried within the actuator assembly 6 and is spring biased to project outwardly from the left-hand end of the actuator 6 to extend below the wall 4*d* when the actuator is in the OFF position as shown in FIG. 1 to lock the actuator against pivotal movement to the ON position as shown in FIG. 2. An operator 10, shown in FIG. 1 as disassembled from the actuator assembly 6, has depending key formations 10*a* molded integrally therewith which extend through openings 6*f* (FIG. 4) in the upper surface of actuator 6 when the operator 10 is assembled to the actuator 6. The lower surfaces of keys 10*a* are beveled to provide a cam surface 10*b* which cams the locking pin 8 inwardly such that its tip is flush with the arcuate profile of the actuator assembly 6. The interior of an upstanding handle portion 10*c* of operator 10 is hollow and complementally formed to the guide 6*c* to guide the member 10 onto the actuator 6.

Operator 10 also has two pairs of integrally molded, laterally opposed tabs 10*d* depending from the lower surface of its sidewalls. The free ends of tabs 10*d* have cam-shaped latching surfaces 10*e* formed on the interior sides thereof. Actuator 6 has pairs of laterally opposed grooves 6*d* formed in its exterior surfaces adjacent opposite ends thereof, the ends of grooves 6*d* terminating in recesses which provide undercut ledges 6*e* in each groove. Operator 10 is operatively coupled to actuator 6 by sliding the operator over the upstanding guide 6*c* such that the keys 10*a* projecting into the aforementioned openings 6*f* and the tabs 10*d* engage within the grooves 6*d*. As the operator 10 is pushed downwardly onto the actuator 6, the cam surfaces 10*e* engage with the lateral surfaces of the grooves 6*d* to cam the tabs 10*d* laterally outwardly as shown in FIG. 6 until the operator is seated upon the upper surface of actuator 6, whereupon the cam surfaces 10*e* engage with the undercut surfaces 6*e* to permit the tabs 10*d* to return to their undeflected condition. The cam surfaces 10*e* and the undercut surfaces 6*e* function as a detent to releasably retain the operator member 10 assembled to the actuator member 6. When so assembled, the locking pin 8 is withdrawn within the actuator 6 and the switch may be manually actuated between the OFF position shown in FIG. 1 and the ON position shown in FIG. 2 by manually moving the handle portion 10*c* of the operator.

The switch may be locked in its OFF position by merely grasping the handle portion 10*c* of operator 10 and pulling the operator linearly from the actuator 6, thereby permitting the locking pin 8 to again project from the left-hand end of actuator 6 below the ledge 4*d*.

Figure 3:
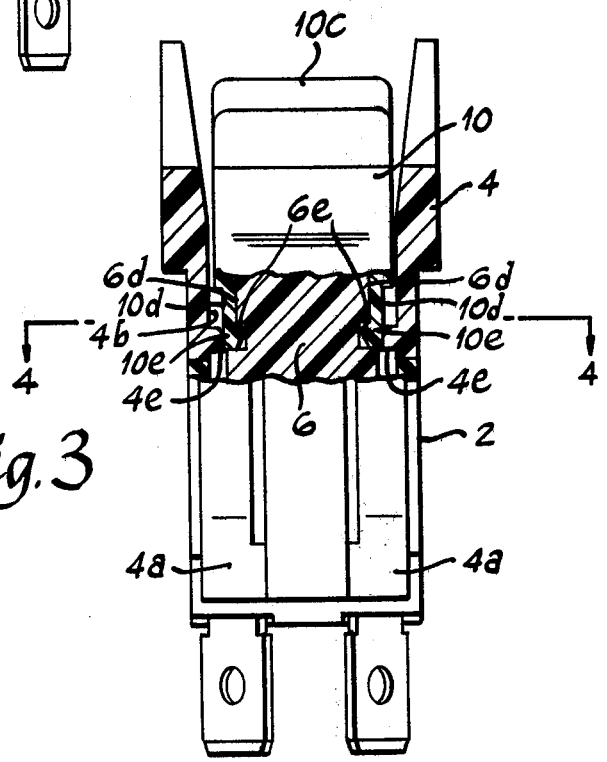
FIG. 3 is a cross-sectional view of the switch taken along line 3—3 in FIG. 2.

To prevent the operator 10 from being removed from actuator 6 when the switch is in the ON position shown in FIG. 2, the opening 4*b* is provided with a pair of laterally aligned, opposed bosses 4*e* which project inwardly from the sidewalls of the opening. The bosses 4*e* are positioned to be below the free end of depending tabs 10*d* within the grooves 6*d* at the right-hand end of the actuator 6 when the switch is in the OFF position (FIG. 1). As will be seen in FIG. 2, when the switch is in the ON position the free ends of tabs 10*d* within the right-hand slots 6*d* are aligned immediately adjacent the bosses 4*e*. As seen in FIGS. 3, 4 and 5 the bosses 4*e* extend inwardly to be disposed in close proximity to the tabs 10*d*, thereby constricting the opening 4*b* this point. Accordingly, the bosses 4*e* prevent the right-hand tabs 10*d* from being cammed outwardly by the coaction between cam surfaces 10*e* and the undercut surface 6*e* if an attempt is made to remove the operator 10 from the actuator 6 when in the ON position. It will be appreciated that the constricting in the opening 4*b* provided by bosses 4*e* can be obtained by other configurations within the opening 4*b* and that the bosses or other configurations can be provided without complicating the molding die for the frame 4 by requirements for additional multi-direction slides or the like.

It is to be understood that the invention hereinbefore described is not intended to be confined to the particular preferred embodiment of pivotable actuator off lock switch having its operator removable only when in the OFF position as disclosed, inasmuch as it is susceptible of various modifications without departing from the scope of the appended claims.

I claim:

1. An electric switch comprising, in combination: an insulating housing having an opening thereon;

switch contacts in said housing;

a pivotally supported actuator within said opening movable between ON and OFF positions for actuating said switch contacts between ON and OFF conditions, respectively;

locking means carried by said actuator and biased for engagement with said housing for preventing movement of said actuator from said OFF position to said ON position;

a manual operator removably coupled to said actuator for releasing said locking means, said operator having resilient coupling means extending along the exterior of said actuator and cammed outwardly by said actuator during coupling movement of said operator to said actuator, said coupling means moving inwardly into engagement with cooperating means on said actuator upon completion of said coupling movement for releasably retaining said operator coupled to said actuator; and means on said housing in juxtaposition with said coupling means when said actuator is moved to said ON position, said means on said housing comprises a constriction in said opening and movement of said actuator to said ON position carries at least one of said coupling means into juxtaposition with said constriction for preventing outward movement of said coupling means.

2. The invention as defined in claim 1 wherein said coupling means are provided adjacent opposite ends of said pivoted actuator and said means on said housing in juxtaposition with said coupling means are provided adjacent one end of said actuator.

3. The invention as defined in claim 1 wherein said coupling means comprises pairs of laterally opposed tabs depending along said actuator on opposite sides of its pivot, said constriction is located beyond the depending ends of one pair of said tabs when said actuator is in said OFF position, and movement of said actuator to said ON position pivots said depending ends of said one pair of tabs into juxtaposition with said constriction.

4. The invention as defined in claim 3 wherein said constriction comprises inwardly projecting bosses formed on laterally opposed sides of said opening.

5. The invention as defined in claim 4 wherein said tabs have inwardly projecting cam surfaces and said cooperating means on said actuator comprises undercut surfaces.

* * * * *